US007148186B2

(12) United States Patent
Kuribayashi et al.

(10) Patent No.: US 7,148,186 B2
(45) **Date of Patent: *Dec. 12, 2006**

(54) LUBRICANT OIL COMPOSITION FOR DIESEL ENGINES (LAW964)

(75) Inventors: Toshiaki Kuribayashi, Saitama (JP); Nobuchika Kawagoishi, Ohi-Machi (JP); Satoshi Ogano, Fujimi (JP)

(73) Assignee: TonenGeneral Sekiyu K.K., Tokyo (JP)

( * ) Notice: Subject to any disclaimer, the term of this patent is extended or adjusted under 35 U.S.C. 154(b) by 400 days.

This patent is subject to a terminal disclaimer.

(21) Appl. No.: 10/384,457

(22) Filed: Mar. 7, 2003

(65) Prior Publication Data

US 2003/0148899 A1 Aug. 7, 2003

Related U.S. Application Data

(63) Continuation of application No. 09/580,688, filed on May 30, 2000, now abandoned.

(51) Int. Cl.
*C10M 141/12* (2006.01)

(52) U.S. Cl. ..... 508/365; 508/376; 508/378; 508/460; 508/518

(58) Field of Classification Search ..... 508/518, 508/365

See application file for complete search history.

(56) References Cited

U.S. PATENT DOCUMENTS 2,714,092 A * 7/1955 Culnane et al. ..... 508/310
5,525,247 A * 6/1996 Miyaji et al. ..... 508/192
5,672,572 A 9/1997 Arai et al. ..... 508/364
5,744,430 A * 4/1998 Inoue et al. ..... 508/295
6,207,625 B1 * 3/2001 Ogano et al. ..... 508/365
6,376,434 B1 * 4/2002 Katafuchi ..... 508/291
6,482,778 B1 * 11/2002 Tersigni et al. ..... 508/188

FOREIGN PATENT DOCUMENTS

| | | |
|---|---|---|
| EP | 0855437 | 7/1998 |
| EP | 1013750 A2 | 6/2000 |
| JP | 54113604 A | 9/1979 |
| JP | 07207290 A | 8/1995 |

* cited by examiner

*Primary Examiner*—Ellen M. McAvoy
(74) *Attorney, Agent, or Firm*—Joseph J. Allocca

(57) ABSTRACT

The present invention provides a lubricant oil composition, having enhanced wear-preventive characteristics for a diesel engine operating with large quantities of soot in the oil (soot content: 0.2 to 4.0 wt. %), and is especially suitable for a pressure-accumulating (common rail) type diesel engine equipped with an EGR system. The lubricant oil composition containing a base oil composed of a mineral and/or synthetic oil incorporated with at least three additives that are a sulfurized oxymolybdenum dithiocarbamate at 0.03 to 0.50 wt. % as Mo; a zinc dialkyl dithiophosphate at 0.04 to 0.50 wt. % as P; and at least one metallic salt of alkyl salicylate selected from the group consisting of a Ca salt of alkyl salicylate at 0.004 to 1.0 wt. % as Ca, Mg salt of alkyl salicylate at 0.002 to 0.60 wt. % as Mg, and Zn salt of alkyl salicylate at 0.006 to 1.60 wt. % as Zn, all percentages being based on the whole composition.

2 Claims, No Drawings

LUBRICANT OIL COMPOSITION FOR DIESEL ENGINES (LAW964)

This application is a Continuation under 37 CFR § 1.53 (b) of U.S. Ser. No. 09/580,688 filed May 30, 2000 now abandoned.

FIELD OF THE INVENTION

This invention relates to a lubricant oil composition for diesel engines, more particularly the composition excellent in wear-preventive characteristics for a diesel engine operating under the lubricating conditions with large quantities of soot in the oil, especially suitable for a pressure-accumulating type (which may be referred to as common rail type) diesel engine equipped with an exhaust gas recycle (referred to as "EGR") system.

BACKGROUND OF THE INVENTION

Lubricant oils have been used to lubricate internal combustion engines, devices in driving systems (e.g., automatic transmissions, shock absorbers and power steerings) and gears having sliding mechanical members for their smooth operation. In particular, lubricant oil for internal combustion engines are used mainly for piston rings, cylinder liners, bearings for crank shafts and connecting rods, valve trains including cams and valve lifters, and other sliding members. They are also used for cooling the engines, cleaning and dispersing combustion products, and prevention of rust and corrosion, in addition to the lubricating purposes. As described above, lubricant oils for internal combustion engines are required to exhibit a variety of functions. These requirements are becoming even more severe, as the engines become more functional, produce higher power and are operated under more severe conditions.

In order to satisfy these requirements, lubricant oils for internal combustion engines are incorporated with a variety of additives, such as antiwear agent, metallic detergent, ashless dispersant and antioxidant. The essential functions of a lubricant oil for internal combustion engines are to prevent wear and seizure by helping the engine operate smoothly under all conditions. Hydrodynamic lubrication prevails in lubricated engine members, but boundary lubrication tends to occur in some sections, e.g., valve trains and dead centers in the cylinders. In general, zinc dithiophosphate or the like is added to prevent wear in the boundary lubrication areas.

More recently, reduction in quantities of spent automobile lubricant oils has been increasingly attracting attention for environmental preservation. In particular, Association of European Automobile Manufacturers is including serviceability of lubricant oils in the specifications of lubricant oils for internal combustion engines. Improved serviceability of the lubricant oils is being required also in Japan.

Air pollution by exhaust gases (in particular, NOx) from diesel engines is becoming severer worldwide, and there are movements to introduce more stringent regulations on NOx and particulate matter emissions from diesel engines. Engine makers are responding to these regulations by an EGR system, which is already adopted for gasoline engines, to clear the NOx regulations. Some of the problems involved in use of an EGR system are still increased quantities of soot in the lubricant oil to aggravate wear of valve trains and piston-cylinder interfaces by soot, making it more difficult to improve serviceability of the lubricant oil.

Moreover, it should be noted that abatement of NOx and particulate matter run counter to each other, when an EGR system is adopted for NOx abatement. One of the methods trying to solve problems of increased particulate matter in an EGR-equipped engine is use of high-pressure fuel injection, where high-pressure fuel is stored in a pressure-accumulating piping system (referred to as common rail) by means of a fuel supply pump and then injected into each engine cylinder under pressure from the common rail via a valve, to improve combustion conditions. It is considered to be essential that the future diesel engine must be equipped with an EGR system and pressure-accumulating type fuel injector simultaneously to clear the more stringent exhaust gas regulations.

It is difficult for the current techniques for preventing wear of valve trains and piston-cylinder interfaces by soot to drastically solve the problems of improving lubricant oil serviceability.

A variety of techniques have been proposed to prevent wear of internal combustion engines, e.g., incorporation of 4 types of additives including zinc dithiophosphate (Japanese Laid-open Patent Application No. 54-103404), a combination of organomolybdenum compound and zinc dithiophosphate (Japanese Laid-open Patent Application No. 54-113604), a combination of organomolybdenum compound, salicylate and bis type succinimide (Japanese Laid-open Patent Application No. 5-230485). The techniques trying to improve serviceability include a combination of organomolybdenum compound, zinc dithiophosphate and polysulfide (Japanese Laid-open Patent Application No. 8-73878, EP699739)

However, in a diesel engine, unlike gasoline engine, the engine oil tends to be contaminated with large quantities of soot evolving as a result of incomplete combustion of diesel fuel oil. It is reported that the soot, having surface activity, may adsorb a polar additive in the engine oil and scrape a coating film away from the friction surface. The required functions of an antiwear agent for diesel engines, therefore, should be much different from those of the agent for gasoline engines under the severe friction conditions with the engine oil contaminated with soot. Therefore, the conventional techniques for compounding antiwear agents, e.g., use of zinc dithiophosphate, may not exhibit sufficient effect of preventing wear under the lubricating conditions with large quantities of soot in the oil. A combination of molybdenum dialkyl dithio-phosphate (Mo content: 200 to 400 ppm), zinc primary alkyl dithiophosphate and salicylate (Japanese Laid-open Patent Application No. 7-207290) and combination of specific contents of sulfurized oxymolybdenum dithiocarbamate and zinc dialkyl dithiophosphate, are some of few additives proposed so far to improve wear-preventive characteristics of the lubricant oils for diesel engines operating under the above conditions.

However, these lubricant oils may not exhibit sufficient effects of preventing wear in an EGR-equipped diesel engine, i.e., under the lubricating conditions with large quantities of soot in the oil. Therefore, the technological development has been strongly demanded for diesel engine lubricant oil compositions which can prevent wear of valve trains and piston-cylinder interfaces.

SUMMARY OF THE INVENTION

One embodiment of the present invention provides for a lubricant oil composition comprising a base oil composed of a mineral and/or synthetic oil incorporated with at least three additives (A), (B) and (C) below, for a diesel engine operating under the lubricating conditions with large quantities of soot in the oil:

(A): a sulfurized oxymolybdenum dithiocarbamate at 0.03 to 0.50 wt. % as Mo, (B): a zinc dialkyl dithiophosphate at 0.04 to 0.50 wt. % as P, and (C): at least one metallic salt of alkyl salicylate selected from the group consisting of a Ca salt of alkyl salicylate at 0.004 to 1.0 wt. % as Ca, Mg salt of alkyl salicylate at 0.002 to 0.60 wt. % as Mg, and Zn salt of alkyl salicylate at 0.006 to 1.60 wt. % as Zn, all percentages being based on the whole composition.

The preferred embodiments also include a method for enhancing wear prevention in an engine and of a lubricating oil by adding the above composition thereto.

The invention may comprise, consist or consist essentially of the steps or elements recited herein.

DETAILED DESCRIPTION OF THE PREFERRED EMBODIMENTS

The inventors have found that a lubricant oil composition incorporated with specific contents of organomolybdenum compound, zinc dithiophosphate and metallic salt of alkyl salicylate (referred to herein as salicylate) surprisingly shows high wear-preventive characteristics even under the lubricating conditions with soot in the lubricant oil, reaching the present invention.

One embodiment of the present invention provides for a lubricant oil composition having enhanced wear-preventive characteristics for a diesel engine operating under lubricating conditions with soot, preferably in large quantities, in the oil, especially suitable for a pressure-accumulating (common rail) type diesel engine equipped with an EGR system.

One embodiment of this invention provides a lubricant oil composition comprising a base oil composed of a mineral and/or synthetic oil incorporated with at least three additives (A), (B) and (C) below, for a diesel engine operating under the lubricating conditions with large quantities of soot in the oil:

(A): a sulfurized oxymolybdenum dithiocarbamate at 0.03 to 0.50 wt. % as Mo, (B): a zinc dialkyl dithiophosphate at 0.04 to 0.50 wt. % as P, and (C): at least one metallic salt of alkyl salicylate selected from the group consisting of a Ca salt of alkyl salicylate at 0.004 to 1.0 wt. % as Ca, Mg salt of alkyl salicylate at 0.002 to 0.60 wt. % as Mg, and Zn salt of alkyl salicylate at 0.006 to 1.60 wt. % as Zn.

The present invention also provides the above lubricant oil composition, which is used for a pressure-accumulating (common rail) type diesel engine equipped with an exhaust gas recycle system.

This invention relates, as described above, to the lubricant oil composition comprising a base oil incorporated with specific contents of sulfurized oxymolybdenum dithiocarbamate, zinc dialkyl dithiophosphate and metallic salt (Ca, Mg or Zn) of alkyl salicylate, for a diesel engine operating under the lubricating conditions with large quantities of soot in the oil, especially a pressure-accumulating (common rail) type diesel engine equipped with an EGR system.

Preferred embodiments of the present invention include:

A lubricant oil composition of one of the above, wherein the base oil is incorporated with a sulfurized oxymolybdenum dithiocarbamate at 0.04 to 0.20 wt. % (400 to 2000 ppm) as Mo.

A lubricant oil composition of one of the above, wherein the base oil is incorporated with a zinc dialkyl dithiophosphate at 0.07 to 0.20 wt. % (700 to 2000 ppm) as P.

A lubricant oil composition of one of the above, wherein the base oil is incorporated with at least one metallic salt of alkyl salicylate selected from the group consisting of a Ca salt of alkyl salicylate having a total base number of 150 mg KOH/g at 0.007 to 0.20 wt. % as Ca, Mg salt of alkyl salicylate having a total base number of 150 mg KOH/g at 0.004 to 0.127 wt. % as Mg, and Zn salt of alkyl salicylate having a total base number of 150 mg KOH/g at 0.012 to 0.20 wt. % as Zn.

A lubricant oil composition of one of the above, which is used under the lubricating condition with 0.2 to 4.0 wt. % of soot in the oil.

A lubricant oil composition of one of the above, wherein the zinc dialkyl dithiophosphate is characterized by a mixed alkyl group with a primary and secondary alkyl group.

A method of enhancing the wear-preventive characteristics of a lubricating oil by adding to a base oil of lubricating viscosity an effective amount of the above composition.

A method of enhancing wear-prevention in an engine by operating the engine in the presence of a lubricating oil composition described above.

With respect to the present invention:

Lubricant Base Oil

The base oil for the lubricant oil composition of the present invention is not limited, and any one which is normally used as a lubricant base oil can be used. In other words, it may be a mineral oil, synthetic oil or a mixture thereof.

The mineral oils useful for the present invention include lubricant stocks, obtained by atmospheric or vacuum distillation of crude, which are treated by various processes, e.g., raffinate from solvent extraction with an aromatic extractant such as phenol, furfural and N-methyl pyrrolidone; hydrotreated oil obtained by treating lubricant stocks with hydrogen under hydrotreatment conditions in the presence of a hydrotreatment catalyst; isomerate obtained by isomerizing wax with hydrogen under isomerization conditions in the presence of an isomerization catalyst; and those lubricant fractions obtained by a combination of solvent refining, hydrotreatment or isomerization. Any process described above can be optionally combined with dewaxing, hydrofinishing, clay treatment or the like operated in a normal manner. More specifically, the mineral oils for the present invention include light, medium and heavy neutral oils, and bright stocks. These base oils can be mixed with one another, to satisfy the requirements of the present invention.

The examples of synthetic base oils useful for the present invention include poly-α-olefin, α-olefin oligomer, polybutene, alkylbenzene, polyol ester, dibasic acid ester, polyoxyalkylene glycol, polyoxyalkylene glycol ether, and silicone oil.

These base oils may be used individually or in combination. A mineral oil may be combined with a synthetic oil. The base oil for the present invention generally has a kinematic viscosity of 2 to 20 $mm^2/s$ at 100° C., preferably 3 to 15 $mm^2/s$. Viscosity beyond the above range causes problems, e.g., excessively increased agitation resistance and coefficient of friction in the hydro-dynamic lubrication region to deteriorate fuel-saving characteristics when it exceeds the above range, and increased wear at sliding members (e.g., valve trains, pistons, rings and bearings of diesel engines) when it is below the above range.

Sulfurized Oxymolybdenum Dithiocarbamate

The sulfurized oxymolybdenum dithiocarbamate (MoDTC) as one of the essential components for the lubricant oil composition of the present invention is shown by the general formula [1]:

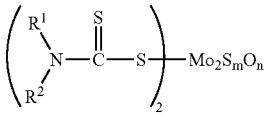

wherein, $R^1$ and $R^2$ are each a hydrocarbon group having a carbon number of 4 to 18, and may be the same or different; and (m) and (n) are each an integer making 4. The hydrocarbon groups of $R^1$ and $R^2$ having a carbon number of 4 to 18 include an alkyl group having a carbon number of 4 to 18, alkenyl group having a carbon number of 4 to 18, cycloalkyl group having a carbon number of 4 to 18, and aryl, alkyl aryl and aryl alkyl group having a carbon number of 6 to 18. These alkyl and alkenyl groups may be of straight-chain or branched. The hydrocarbon group shown by $R^1$ or $R^2$ for the present invention particularly preferably has a carbon number of 4 to 13. The concrete examples of the hydrocarbon groups shown by $R^1$ and $R^2$ include butyl, pentyl, hexyl, heptyl, 2-ethyl hexyl, octyl, nonyl, decyl, undecyl, dodecyl, tridecyl, octenyl, nonenyl, decenyl, undecenyl, dodecenyl, tridecenyl, tetradecenyl, hexadecenyl, octadecenyl, dimethyl cyclohexyl, ethyl cyclohexyl, methyl cyclohexylmethyl, cyclohexylethyl, propyl cyclohexyl, butyl cyclohexyl, heptyl cyclohexyl, dimethyl phenyl, methyl benzyl, phenetyl, naphthyl, and dimethyl naphthyl. These sulfurized oxymolybdenum dithiocarbamates may be used either individually or in combination for the present invention. The sulfurized oxymolybdenum dithiocarbamate is incorporated at 0.03 to 0.50 wt. % (300 to 5000 ppm) as molybdenum (Mo) derived therefrom, based on the whole composition, preferably 0.04 to 0.20 (400 to 2000 ppm). At below 0.03 wt. %, the lubricant oil may not sufficiently exhibit its wear-preventive effect. At above 0.50 wt. %, on the other hand, the effect is not increased for the quantity of the dithiocarbamate used, and sludge may be formed more easily.

Zinc Dialkyl Dithiophosphate

The zinc dialkyl dithiophosphate (ZnDTP) as one of the essential components for the lubricant oil composition of the present invention is shown by the general formula [2]:

[2]

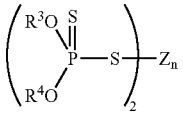

wherein, $R^3$ and $R^4$ are each a primary or secondary alkyl group having a carbon number of 1 to 18, and may be the same or different. The primary or secondary alkyl groups of $R^3$ and $R^4$ having a carbon number of 1 to 18, shown by the general formula [2], include methyl, ethyl, propyl, butyl, pentyl, hexyl, heptyl, 2-ethyl hexyl, octyl, nonyl, decyl, undecyl, dodecyl, tridecyl, tetradecyl, pentadecyl, hexadecyl, heptadecyl, and octadecyl. However, the preferable zinc dialkyl dithiophosphate for the lubricant oil composition of the present invention has a mixed alkyl group of primary and secondary alkyl groups having a carbon number of 3 to 12. The primary alkyl group would be mainly used when resistance of the lubricant oil composition to heat and oxidation are of critical importance. However, it may cause increased wear at valve trains and other members as content of soot in the oil increases as a result of exhaust gas recycling used for cleaning the exhaust gases, and hence normally used in combination with the secondary alkyl to control the wear. The zinc dialkyl dithiophosphates having a mixed alkyl group of primary and secondary alkyl groups may be used either individually or in combination for the lubricant oil composition of the present invention. The zinc dialkyl dithiophosphate is incorporated at 0.04 to 0.50 wt. % as phosphorus (P) derived therefrom, based on the whole composition, preferably 0.07 to 0.20 wt. %. At below 0.04 wt. %, the lubricant oil may not sufficiently exhibit its wear-preventive effect under the lubricating conditions with soot in the oil. At above 0.50 wt. %, on the other hand, the effect is not increased for the quantity of the dithiophosphate used.

Metallic Salt of Alkyl Salicylate

The metallic salt of alkyl salicylate as one of the essential components for the lubricant oil composition of the present invention is shown by the general formula [3] or [4], the latter representing a sulfide of the metallic salt of the former:

[3]

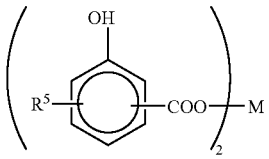

[4]

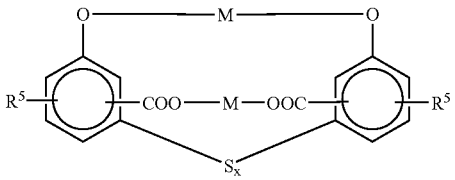

wherein, $R^5$ is an alkyl group having a carbon number of 1 to 18; M is calcium or magnesium as an alkaline-earth metal, or zinc as a Group 2B metal; and (x) is an integer of 1 to 4. The alkyl groups of $R^5$ in the general formula [3] or [4] include methyl, ethyl, propyl, butyl, pentyl, hexyl, heptyl, 2-ethyl hexyl, octyl, nonyl, decyl, undecyl, dodecyl, tridecyl, tetradecyl, pentadecyl, hexadecyl, heptadecyl, and octadecyl. However, the especially preferable alkyl group for the lubricant oil composition of the present invention is of straight chain or branched, having a carbon number of 4 to 20. A boron derivative of the above metallic salt of alkyl salicylate may be also used.

The metallic (Ca, Mg or Zn) salt of alkyl salicylate for the present invention preferably has a total base number of 150 mg KOH/g or less, more preferably 30 to 150 mg KOH/g. Total base number is determined by the perchloric acid method, in accordance with JIS K2501.

The metallic (Ca, Mg or Zn) salt of alkyl salicylate is incorporated at 0.004 to 1.0 wt. % as calcium (Ca) derived therefrom in the case of Ca salt, based on the whole composition, preferably 0.007 to 0.20 wt. %; and/or at 0.002 to 0.60 wt. % as magnesium (Mg) derived therefrom in the case of Mg salt, preferably 0.004 to 0.13 wt. %; and/or at 0.006 to 1.60 wt. % as zinc (Zn) derived therefrom in the case of Zn salt, preferably 0.012 to 0.20 wt. %. At below 0.004 wt. % in the case of the Ca salt, 0.002 wt. % in the case of the Mg salt or 0.006 wt. % in the case of Zn salt, the lubricant oil may not sufficiently exhibit its wear-preventive effect under the lubricating conditions with soot in the oil. On the other hand, at above 1.0 wt. % in the case of the Ca salt, 0.60 wt. % in the case of the Mg salt or 1.60 wt. % in the case of Zn salt, the effect is not increased for the quantity of the metallic salt used.

The lubricant oil composition of the present invention may not sufficiently exhibit its wear-preventive effect under the lubricating conditions with soot in the oil, unless its base oil is incorporated simultaneously with the sulfurized oxymolybdenum dithiocarbamate, zinc dialkyl dithiophosphate and metallic salt of alkyl salicylate at a specific content.

The mechanisms involved in prevention of wear under the lubricating conditions with soot in the oil in the simultaneous presence of the sulfurized oxymolybdenum dithiocarbamate, zinc dialkyl dithiophosphate and metallic salt of alkyl salicylate are not fully substantiated. It is however considered that the zinc dialkyl dithiophosphate as the antiwear agent is adsorbed by the metallic surface to form thereon an inorganic extreme pressure coating film, containing sulfur, phosphorus and zinc, which functions wear prevention, and that the sulfurized oxymolybdenum dithiocarbamate as the friction-reducing agent is thermally decomposed on the friction surface to form molybdenum disulfide in the interface, thereby reducing wear and friction. Formation of the extreme pressure coating film of the zinc dialkyl dithiophosphate and that of molybdenum disulfide from the sulfurized oxymolybdenum dithiocarbamate in the interface compete with other, and, at the same time, they are coexisting. However, a lubricating oil is contaminated with soot in a diesel engine, in particular an EGR-equipped one. The soot tends to scrape the coating film away from the friction surface. The lubricant oil composition incorporated only with the zinc dialkyl dithiophosphate cannot exhibit sufficient wear-preventive effect, because the extreme pressure coating film is scraped away by soot faster than it is formed. Similarly, the lubricant oil composition incorporated only with the sulfurized oxymolybdenum dithiocarbamate cannot exhibit sufficient friction-reducing and wear-preventive effects provided by the film of molybdenum disulfide formed on the friction surface, because it is scraped away by soot faster than it is formed.

Surprisingly, it is considered that, in the presence of the three essential additives for the lubricant oil of the present invention, soot acts only on molybdenum disulfide formed on the friction surface of the sulfurized oxymolybdenum dithiocarbamate to scrape away the coating film on the friction surface, leaving the extreme pressure film of the zinc dialkyl dithiophosphate essentially unaffected. This can be backed up by the observation that, in the simultaneous presence of these two additives, the friction-reducing effect is affected by the presence of soot, whereas the wear-preventive effect is relatively insensitive to the presence of soot.

The lubricant oil composition of the present invention is used for a diesel engine which operates under the lubricating conditions with large quantities of soot in the oil. Content of soot in the lubricating oil is in a range from 0.2 to 4.0 wt. %, preferably 0.5 to 4.0 wt. %. Soot content (wt. %) in the oil, described in this specification, means content of n-hexane-insolubles, determined by the ultracentrifugation method (centrifugal force: 36,790 G, speed of rotation: 17,500 rpm, time: 30 min, number of runs: 3, temperature: 0° C).

Other Additive Components

The lubricant oil composition of the present invention comprises a base oil incorporated with the essential components of sulfurized oxymolybdenum dithiocarbamate, zinc dialkyl dithiophosphate and metallic salt of alkyl salicylate. The base oil may be optionally incorporated further with one or more types of additives, in order to meet various functions the lubricant oil for diesel engines is required to exhibit, so long as the object of the present invention is not damaged. These additives include viscosity index improver, pour point depressant, ashless dispersant, metallic detergent, antioxidant, friction-reducing agent, antiwear agent, extreme pressure agent, metal deactivator, rust inhibitor, antifoamant, corrosion inhibitor and coloring agent.

The viscosity index improvers useful for the present invention generally include a polymethacrylate-based one, olefin copolymer-based one (e.g., polyisobutylene-based and ethylene-propylene copolymer-based one), polyalkyl styrene-based one, hydrogenated styrene-butadiene copolymer-based one, and styrene-maleic anhydride ester copolymer-based one. It is incorporated normally at 1 to 30 wt. %.

The pour point depressants useful for the present invention generally include an ethylene-vinyl acetate copolymer, condensate of chlorinated paraffin and naphthalene, condensate of chlorinated paraffin and phenol, polymethacrylate, and polyalkyl styrene. Of these, a polymethacrylate is preferably used. It is incorporated normally at 0.01 to 5 wt. %.

The ashless dispersants useful for the present invention include those based on a polyalkenyl succinimide, polyalkenyl succinamide, benzyl amine, succinic acid ester, and succinic acid-amide, and those containing boron. Of these, a polyalkenyl succinimide (polybutenyl succinimide)-based one is preferably used. It is incorporated normally at 0.1 to 15 wt. %.

The metallic detergents useful for the present invention include those based on sulfonate, phenate, salicylate and phosphonate of Ca, Mg, Ba, Na or the like, in addition to the salicylate of Ca, Mg or Zn as the essential component for the lubricant oil composition of the present invention. It is incorporated normally at 0.05 to 5 wt. %.

The antioxidants useful for the present invention generally include an amine-based one, e.g., alkylated diphenyl amine, phenyl-α-naphthyl amine and alkylated phenyl-α-naphthyl amine; phenol-based one, e.g., 2,6-ditertiary butyl phenol and 4,4'-methylene bis-(2,6-ditertiary butyl phenol); sulfur-based one, e.g., dilauryl-3,3'-thiodipropionate; phosphorus-based one, e.g., phosphite; and zinc dithiophosphate. Of these, an amine-based and phenol-based one are preferably used. It is incorporated normally at 0.05 to 5 wt. %.

The friction-reducing agents useful for the present invention include a fatty acid, higher alcohol, fatty acid ester, partial ester of polyhydric alcohol, fatty acid ester, oil and fat, amine, amide, sulfurized ester, phosphate ester, phosphite ester and phosphate ester amine, in addition to the organomolybdenum compound as the essential component for the present invention. It is incorporated normally at 0.05 to 3 wt. %.

The antiwear agents useful for the present invention include a metallic (e.g., Pb, Sb or Mo) salt of dithiophosphate, metallic (e.g., Zn, Pb, Sb or Mo) salt of dithiocarbamate, metallic (e.g., Pb) salt of naphthenate, metallic (e.g., Pb) salt of fatty acid, boron compound, phosphate ester, phosphite ester and phosphate amine, in addition to the zinc dithiophosphate as the essential component for the present invention. It is incorporated normally at 0.1 to 5 wt. %.

The extreme pressure agents useful for the present invention generally include an ashless-based sulfide compound, sulfurized oil and fat, phosphate ester, phosphite ester and phosphate ester amine. It is incorporated normally at 0.05 to 3 wt. %.

The metal deactivators useful for the present invention include benzotriazole, and a triazole, benzotriazole and thiadiazole derivative. It is incorporated normally at 0.001 to 3 wt. %.

The rust inhibitors useful for the present invention include a fatty acid, alkenyl succinic acid half ester, fatty acid soap, alkyl sulfonate, ester of a fatty acid and polyhydric alcohol, fatty acid amine, oxidized paraffin and alkyl polyoxyethylene ether. It is incorporated normally at 0.01 to 3 wt. %.

The antifoaming agents useful for the present invention include a dimethyl polysiloxane and polyacrylate. It is incorporated normally at a very small content, e.g., around 0.002 wt. %.

The lubricant oil composition of the present invention may be further incorporated, as required, with other types of additives, e.g., corrosion inhibitor and coloring agent.

EXAMPLES

The present invention is described further in detail by EXAMPLES and COMPARATIVE EXAMPLES, which do not limit the present invention. The wear-preventive characteristics were measured on a specimen (friction material) using a reciprocating type (SRV) friction/wear tester under the following conditions in EXAMPLES and COMPARATIVE EXAMPLES: Test conditions: Plate: 24 mm in diameter, 7 mm thick, Cylinder: 15 mm in diameter, 22 mm long, Temperature: 80° C., Load: 150 N, Amplitude: 1.5 mm, Frequency: 50 Hz, Testing period: 30 min.

Examples 1 to 2 and Reference Example 1

REFERENCE EXAMPLE 1 used a solvent-refined paraffinic mineral oil (viscosity: 5.6mm$^2$/s at 100° C.) as the base oil, which was incorporated with a zinc dialkyl dithiophosphate, whose alkyl group was a mixture of primary C8 and secondary C3/C6 (primary/secondary alkyl ratio: 10/9 by weight) at 0.14 wt. % as phosphorus, based on the whole composition; sulfurized oxymolybdenum dithiocarbamate at 0.07 wt. % (700 ppm) as molybdenum; calcium salt of alkyl salicylate (Ca salicylate) having a total base number (TBN) of 70 mg KOH/g at 0.004 wt. % (40 ppm) as calcium; and other types of additives, e.g., metallic detergent, ashless dispersant, viscosity index improver, pour point depressant, antioxidant and antifoaming agent at a total content of 15.0 wt. %. A commercial diesel engine was operated with the base oil to collect the soot, and the concentrated soot was incorporated in the above lubricant oil compositions at 2.0 wt. % for EXAMPLE 1 and 4.0 wt. % for EXAMPLE 2. These lubricant oil compositions were tested to determine wear scar diameter by an SRV friction/wear tester. The results are given in Table 1.

Examples 3 to 14, and Reference Examples 2 to 7

These examples used a solvent-refined paraffinic mineral oil (viscosity: 5.6mm$^2$/s at 100° C.) as the base oil, as were the cases with EXAMPLES 1 and 2, which was incorporated with a zinc dialkyl dithiophosphate, whose alkyl group was a mixture of primary C8 and secondary C3/C6 (primary/secondary alkyl ratio: 10/9 by weight), sulfurized oxymolybdenum dithiocarbamate; and Ca, Mg or Zn salt of alkyl salicylate (having a TBN of 70, 345 or 132 mg KOH/g in the case of the Ca, Mg or Zn salt, respectively) at contents given in Tables 1 to 3. The base oil was further incorporated with other types of additives, e.g., metallic detergent, ashless dispersant, viscosity index improver, pour point depressant, antioxidant and antifoaming agent at a total content of 15.0 wt. %, also as were the cases with EXAMPLES 1 and 2. A commercial diesel engine was operated with the base oil to collect the soot, and the concentrated soot was incorporated in the above lubricant oil composition at a content given in Table 1 to 3. These lubricant oil compositions were tested to determine wear scar diameter by an SRV friction/wear tester. The results are given also in Tables 1 to 3.

Comparative Examples 1 to 13, and Reference Examples 8 to 11

These examples prepared the lubricant oil compositions given in Tables 3 to 4, which show the lubricant base oil component, additive components and soot content for each example. In particular, COMPARATIVE EXAMPLE 13 used sulfurized oxymolybdenum dithiophosphate (MoDTP) in place of sulfurized oxymolybdenum dithiocarbamate. These lubricant oil compositions were tested to determine wear scar diameter by an SRV friction/wear tester, as were the cases with EXAMPLES 1 to 14. The results are given in Tables 3 to 4.

TABLE 1

| | | REFERENCE EXAMPLE 1 | EXAMPLE 1 | EXAMPLE 2 | REFERENCE EXAMPLE 2 | EXAMPLE 3 | EXAMPLE 4 | REFERENCE EXAMPLE 3 | EXAMPLE 5 | EXAMPLE 6 |
|---|---|---|---|---|---|---|---|---|---|---|
| Base oil: Mineral oil, Viscosity: 5.6 nm$^2$/s at 100° C. | | Balance | Balance | Balance | Balance | Balance | Balance | Balance | Balance | Balance |
| Additive components, wt. % | ZnDTP(as P) | 0.14 | 0.14 | 0.14 | 0.14 | 0.14 | 0.14 | 0.14 | 0.14 | 0.14 |
| | MoDTC(as Mo) | 0.07 | 0.07 | 0.07 | 0.07 | 0.07 | 0.07 | 0.07 | 0.07 | 0.07 |
| | MoDTP(as Mo) | 0 | 0 | 0 | 0 | 0 | 0 | 0 | 0 | 0 |
| | Ca salicylate, TBN: 70 mg KOH/g (as Ca) | 0.004 | 0.004 | 0.004 | 0 | 0 | 0 | 0 | 0 | 0 |
| | Zn salicylate, TBN: 132 mg KOH/g (as Zn) | 0 | 0 | 0 | 0.006 | 0.006 | 0.006 | 0 | 0 | 0 |
| | Mg salicylate, TBN: 345 mg KOH/g (as Mg) | 0 | 0 | 0 | 0 | 0 | 0 | 0.002 | 0.002 | 0.002 |
| | Ca sulfonate, TBN: 80 mg KOH/g (as Ca) | 0 | 0 | 0 | 0 | 0 | 0 | 0 | 0 | 0 |
| | Ca phenate, TBN: 90 mg KOH/g (as Ca) | 0 | 0 | 0 | 0 | 0 | 0 | 0 | 0 | 0 |
| | Other additives*1 | Added | Added | Added | Added | Added | Added | Added | Added | Added |

TABLE 1-continued

| | REFERENCE EXAMPLE 1 | EXAMPLE 1 | EXAMPLE 2 | REFERENCE EXAMPLE 2 | EXAMPLE 3 | EXAMPLE 4 | REFERENCE EXAMPLE 3 | EXAMPLE 5 | EXAMPLE 6 |
|---|---|---|---|---|---|---|---|---|---|
| Soot content in oil (wt. %) | 0 | 2.0 | 4.0 | 0 | 2.0 | 4.0 | 0 | 2.0 | 4.0 |
| Wear scar diameter (mm), determined by an SRV friction/wear tester*2 | 0.143 | 0.175 | 0.177 | 0.149 | 0.179 | 0.177 | 0.147 | 0.176 | 0.178 |

*1Other additives used were a metallic detergent, ashless dispersant, viscosity index improver, pour point of depressant and antifoaming agent.
*2Wear scar diameter was determined by an SRV friction/wear tester under the conditions of temperature: 80° C., time: 30 min., load: 150 N, amplitude: 1.5 mm and frequency: 50 Hz.

TABLE 2

| | | REFERENCE EXAMPLE 4 | EXAMPLE 7 | EXAMPLE 8 | REFERENCE EXAMPLE 5 | EXAMPLE 9 | EXAMPLE 1000 | REFERENCE EXAMPLE 6 | EXAMPLE 1100 | EXAMPLE 1200 |
|---|---|---|---|---|---|---|---|---|---|---|
| Base oil: Mineral oil, Viscosity: 5.6 $nm^2/s$ at 100° C. | | Balance | Balance | Balance | Balance | Balance | Balance | Balance | Balance | Balance |
| Additive components, wt. % | ZnDTP(as P) | 0.14 | 0.14 | 0.14 | 0.14 | 0.14 | 0.14 | 0.14 | 0.14 | 0.14 |
| | MoDTC(as Mo) | 0.07 | 0.07 | 0.07 | 0.07 | 0.07 | 0.07 | 0.07 | 0.07 | 0.07 |
| | MoDTP(as Mo) | 0 | 0 | 0 | 0 | 0 | 0 | 0 | 0 | 0 |
| | Ca salicylate, TBN: 70 mg KOH/g (as Ca) | 0.007 | 0.007 | 0.007 | 0 | 0 | 0 | 0 | 0 | 0 |
| | Zn salicylate, TBN: 132 mg KOH/g (as Zn) | 0 | 0 | 0 | 0.012 | 0.012 | 0.012 | 0 | 0 | 0 |
| | Mg salicylate, TBN: 345 mg KOH/g (as Mg) | 0 | 0 | 0 | 0 | 0 | 0 | 0.004 | 0.004 | 0.004 |
| | Ca sulfonate, TBN: 80 mg KOH/g (as Ca) | 0 | 0 | 0 | 0 | 0 | 0 | 0 | 0 | 0 |
| | Ca phenate, TBN: 90 mg KOH/g (as Ca) | 0 | 0 | 0 | 0 | 0 | 0 | 0 | 0 | 0 |
| | Other additives*1 | Added | Added | Added | Added | Added | Added | Added | Added | Added |
| Soot content in oil (wt. %) | | 0 | 2.0 | 4.0 | 0 | 2.0 | 4.0 | 0 | 2.0 | 4.0 |
| Wear scar diameter (mm), determined by an SRV friction/wear tester*2 | | 0.143 | 0.173 | 0.176 | 0.147 | 0.179 | 0.178 | 0.145 | 0.175 | 0.177 |

*1Other additives used were a metallic detergent, ashless dispersant, viscosity index improver, pour point depressant and antifoaming agent.
*2Wear scar diameter was determined by an SRV friction/wear tester under the conditions of temperature: 80° C., time: 30 min., load: 150 N, amplitude: 1.5 mm and frequency: 50 Hz.

TABLE 3

| | | REFERENCE EXAMPLE AMPLE 7 | EXAMPLE 1300 | EXAMPLE 1400 | REFERENCE EXAMPLE 8 | COMPARATIVE EXAMPLE 1 | COMPARATIVE EXAMPLE 2 |
|---|---|---|---|---|---|---|---|
| Base oil: Mineral oil, Viscosity: 5.6 $nm^2/s$ at 100° C. | | Balance | Balance | Balance | Balance | Balance | Balance |
| Additive components, wt. % | ZnDTP(as P) | 0.14 | 0.14 | 0.14 | 0.14 | 0.14 | 0.14 |
| | MoDTC(as Mo) | 0.07 | 0.07 | 0.07 | 0.07 | 0.07 | 0.07 |
| | MoDTP(as Mo) | 0 | 0 | 0 | 0 | 0 | 0 |
| | Ca salicylate, TBN: 70 mg KOH/g (as Ca) | 0.176 | 0.176 | 0.176 | 0 | 0 | 0 |
| | Zn salicylate, TBN: 132 mg KOH/g (as Zn) | 0 | 0 | 0 | 0 | 0 | 0 |
| | Mg salicylate, TBN: 345 mg KOH/g (as Mg) | 0 | 0 | 0 | 0 | 0 | 0 |
| | Ca sulfonate, TBN: 80 mg KOH/g (as Ca) | 0 | 0 | 0 | 0 | 0 | 0 |
| | Ca phenate, TBN: 90 mg KOH/g (as Ca) | 0 | 0 | 0 | 0 | 0 | 0 |
| | Other additives*1 | Added | Added | Added | Added | Added | Added |
| Soot content in oil (wt. %) | | 0 | 2.0 | 4.0 | 0 | 2.0 | 4.0 |
| Wear scar diameter (mm), determined by an SRV friction/wear tester*2 | | 0.140 | 0.172 | 0.171 | 0.144 | 0.200 | 0.226 |

| | | COMPARATIVE EXAMPLE 3 | REFERENCE EXAMPLE 9 | COMPARATIVE EXAMPLE 4 | COMPARATIVE EXAMPLE 5 | COMPARATIVE EXAMPLE 6 |
|---|---|---|---|---|---|---|
| Base oil: Mineral oil, Viscosity: 5.6 $nm^2/s$ at 100° C. | | Balance | Balance | Balance | Balance | Balance |
| Additive components, | ZnDTP(as P) | 0.14 | 0.14 | 0.14 | 0.14 | 0.14 |
| | MoDTC(as Mo) | 0.07 | 0 | 0 | 0 | 0 |

TABLE 3-continued

| | | | | | | |
|---|---|---|---|---|---|---|
| wt. % | MoDTP(as Mo) | 0 | 0 | 0 | 0 | 0 |
| | Ca salicylate, TBN: 70 mg KOH/g (as Ca) | 0 | 0 | 0 | 0 | 0 |
| | Zn salicylate, TBN: 132 mg KOH/g (as Zn) | 0 | 0 | 0 | 0 | 0 |
| | Mg salicylate, TBN: 345 mg KOH/g (as Mg) | 0 | 0 | 0 | 0 | 0 |
| | Ca sulfonate, TBN: 80 mg KOH/g (as Ca) | 0 | 0 | 0 | 0 | 0 |
| | Ca phenate, TBN: 90 mg KOH/g (as Ca) | 0 | 0 | 0 | 0 | 0 |
| | Other additives*1 | Added | Added | Added | Added | Added |
| Soot content in oil (wt. %) | | 5.0 | 0 | 2.0 | 4.0 | 5.0 |
| Wear scar diameter (mm), determined by an SRV friction/wear tester*2 | | 0.234 | 0.161 | 0.262 | 0.276 | 0.278 |

*1Other additives used were a metallic detergent, ashless dispersant, viscosity index improver, pour point depressant and antifoaming agent.

*2Wear scar diameter was determined by an SRV friction/wear tester under the conditions of temperature: 80° C., time: 30 min., load: 150 N, amplitude: 1.5 mm and frequency: 50 Hz.

TABLE 4

| | | REFERENCE EXAMPLE 1000 | COMPARATIVE EXAMPLE 7 | COMPARATIVE EXAMPLE 8 | COMPARATIVE EXAMPLE 9 | REFERENCE EXAMPLE 1100 |
|---|---|---|---|---|---|---|
| Base oil: Mineral oil, Viscosity: 5.6 $nm^2/s$ at 100° C. | | Balance | Balance | Balance | Balance | Balance |
| Additive components, wt. % | ZnDTP(as P) | 0.14 | 0.14 | 0.14 | 0.14 | 0.14 |
| | MoDTC(as Mo) | 0.07 | 0.07 | 0.07 | 0.07 | 0.07 |
| | MoDTP(as Mo) | 0 | 0 | 0 | 0 | 0 |
| | Ca salicylate, TBN: 70 mg KOH/g (as Ca) | 0 | 0 | 0 | 0 | 0 |
| | Zn salicylate, TBN: 132 mg KOH/g (as Zn) | 0 | 0 | 0 | 0 | 0 |
| | Mg salicylate, TBN: 345 mg KOH/g (as Mg) | 0 | 0 | 0 | 0 | 0 |
| | Ca sulfonate, TBN: 80 mg KOH/g (as Ca) | 0.377 | 0.377 | 0.377 | 0.377 | 0 |
| | Ca phenate, TBN: 90 mg KOH/g (as Ca) | 0 | 0 | 0 | 0 | 0.271 |
| | Other additives*1 | Added | Added | Added | Added | Added |
| Soot content in oil (wt. %) | | 0 | 2.0 | 4.0 | 5.0 | 0 |
| Wear scar diameter (mm), determined by an SRV friction/wear tester*2 | | 0.156 | 0.195 | 0.197 | 0.198 | 0.168 |

| | | COMPARATIVE EXAMPLE 1000 | COMPARATIVE EXAMPLE 1100 | COMPARATIVE EXAMPLE 1200 | COMPARATIVE EXAMPLE 1300 |
|---|---|---|---|---|---|
| Base oil: Mineral oil, Viscosity: 5.6 $nm^2/s$ at 100° C. | | Balance | Balance | Balance | Balance |
| Additive components, wt. % | ZnDTP(as P) | 0.14 | 0.14 | 0.14 | 0.14 |
| | MoDTC(as Mo) | 0.07 | 0.07 | 0.07 | 0 |
| | MoDTP(as Mo) | 0 | 0 | 0 | 0.07 |
| | Ca salicylate, TBN: 70 mg KOH/g (as Ca) | 0 | 0 | 0 | 0.004 |
| | Zn salicylate, TBN: 132 mg KOH/g (as Zn) | 0 | 0 | 0 | 0 |
| | Mg salicylate, TBN: 345 mg KOH/g (as Mg) | 0 | 0 | 0 | 0 |
| | Ca sulfonate, TBN: 80 mg KOH/g (as Ca) | 0 | 0 | 0 | 0 |
| | Ca phenate, TBN: 90 mg KOH/g (as Ca) | 0.271 | 0.271 | 0.271 | 0 |
| | Other additives*1 | Added | Added | Added | Added |
| Soot content in oil (wt. %) | | 2.0 | 4.0 | 5.0 | 2.0 |
| Wear scar diameter (mm), determined by an SRV friction/wear tester*2 | | 0.197 | 0.198 | 0.198 | 0.196 |

*1Other additives used were a metallic detergent, ashless dispersant, viscosity index improver, pour point depressant and antifoaming agent.

*2Wear scar diameter was determined by an SRV friction/wear tester under the conditions of temperature: 80° C., time: 30 min., load: 150 N, amplitude: 1.5 mm and frequency: 50 Hz.

The results of EXAMPLES and COMPARATIVE EXAMPLES demonstrate that a lubricant oil composition whose base oil was incorporated with, as the essential components, (A) sulfurized oxymolybdenum dithiocarbamate, (B) zinc dialkyl dithiophosphate and (C) metallic salt of alkyl salicylate (having a TBN of 70, 345 or 132 mg KOH/g in the case of Ca, Mg or Zn salt, respectively) at a specific content exhibits enhanced wear-preventive characteristics for valve trains and other members under the lubricating conditions with soot in the oil. It is particularly noted that the lubricant oil composition incorporated with the three types of additives, a sulfurized oxymolybdenum dithiocarbamate, zinc dialkyl dithiophosphate and metallic (Ca, Mg or Zn) salt of alkyl salicylate, exhibits enhanced wear-preventive characteristics in comparison to the one incorporated with a sulfurized oxymolybdenum dithiocarbamate and zinc dialkyl dithiophosphate, prepared by COMPARATIVE EXAMPLE.

It is therefore apparent that a lubricant oil composition may not sufficiently exhibit its wear-preventive effect under the lubricating conditions with soot in the oil, and hence may not have sufficient quality as the lubricant oil for diesel engines, particularly a pressure-accumulating type one equipped with an EGR system, unless its base oil is incorporated simultaneously with a specific sulfurized oxymolybdenum dithiocarbamate, zinc dialkyl dithiophosphate and metallic salt of alkyl salicylate at a specific content, In other words, a lubricant oil composition for diesel engines exhibiting enhanced wear-preventive effect for valve trains and other members under the lubricating conditions with soot in the oil can be obtained by incorporating its base oil with (A) sulfurized oxymolybdenum dithiocarbamate, (B) zinc dialkyl dithiophosphate and (C) metallic (Ca, Mg or Zn) salt of alkyl salicylate at a specific content.

The lubricant oil composition of the present invention exhibits enhanced wear-preventive effect for valve trains and other members under the lubricating conditions with 0.5 to 4.0 wt. % of soot in the oil by incorporating its base oil with (A) sulfurized oxymolybdenum dithiocarbamate, (B) zinc dialkyl dithiophosphate and (C) metallic (Ca, Mg or Zn) salt of alkyl salicylate at a specific content, and hence suitable for a diesel engine operating under the conditions with large quantities of soot in the oil, particularly pressure-accumulating type ones equipped with an EGR system.

What is claimed is:

1. A method for enhancing wear prevention in a pressure accumulating diesel engine equipped with an exhaust gas recycle system and operating under lubricating conditions with large quantifies of soot in the oil, said amount of soot being in the 2.0 to 4.0 wt % range, by providing to the diesel engine a lubricating oil composition comprising a base oil selected from a mineral or synthetic oil incorporated with a combination of additives comprising a sulfurized oxymolybdenum dithiocarbamate at 0.03 to 0.50 wt % as Mo, a zinc dialkyldithio-phosphate at 0.04 to 0.50- wt % as P; and at least one metal salt of alkyl salicylate selected from the group consisting of a Ca salt of alkyl salicylate at 0.004 to 1.0 wt % as Ca; Mg salt of alkyl salicylate at 0.002 to 0.60 wt % as Mg, and Zn salt of alkyl salicylate at 0.006 to 1.60 wt % or Zn, all percentages being based on the whole composition, the degree of wear prevention enhancement being superior to that exhibited in said diesel engine lubricated by a lubricating oil which lacks the Ca, Mg or Zn salt of alkyl salicylate.

2. The method of claim 1 for enhancing wear prevention in a pressure accumulating diesel engine equipped with an exhaust gas recycle system and operating under lubricating conditions with from 2.0 to 4.0 wt % soot in the oil by providing to the diesel engine a lubricating oil composition comprising a base oil selected from a mineral or synthetic oil incorporated with a combination of additives wherein the sulfurized oxymolybdenum dithiocarbamate is present at 0.04 to 0.20 wt % as Mo; and/or the zinc dialkyl dithiophosphate is present at 0.07 to 0.20 wt % as P; and/or the Ca salt of alkyl salicylate has a total base number of 150 mg KOH/g or less and is present at 0.007 to 0.20 wt % as Ca, and/or the Mg salt of alkyl salicylate has a total base number of 150 mg KOH/g or less and is present at 0.004 to 0.13 wt % as Mg, and/or the Zn salt of alkyl salicylate has a total base number of 150 mg KOH/g or less and is present at 0.012 to 0.20 wt % as Zn, all percentages being based on the whole lubricating oil, the degree of wear protection enhancement being superior to that exhibited in said diesel engine lubricated by a lubricating oil which lacks said Ca, Mg or Zn salt of alkyl salicylate.

* * * * *